US010018344B2

(12) United States Patent
Chen et al.

(10) Patent No.: US 10,018,344 B2
(45) Date of Patent: Jul. 10, 2018

(54) PLUG-IN BULB COUPLING STRUCTURE

(71) Applicant: FAVORU ELECTRONIC CO., LTD., Zhuhai, Guangdong (CN)

(72) Inventors: Jiansheng Chen, Guangdong (CN); Ping Wang, Guangdong (CN); Jun Fang, Guangdong (CN)

(73) Assignee: FAVORU ELECTRONIC CO., LTD., Zhuhai (CN)

( * ) Notice: Subject to any disclaimer, the term of this patent is extended or adjusted under 35 U.S.C. 154(b) by 269 days.

(21) Appl. No.: 14/988,772

(22) Filed: Jan. 6, 2016

(65) Prior Publication Data

US 2017/0159922 A1 Jun. 8, 2017

(30) Foreign Application Priority Data

Dec. 4, 2015 (CN) ..... 2015 1 0980833

(51) Int. Cl.

| | |
|---|---|
| ***H01R 33/06*** | (2006.01) |
| ***F21V 23/06*** | (2006.01) |
| ***F21V 15/01*** | (2006.01) |
| ***F21V 21/002*** | (2006.01) |
| ***F21V 23/00*** | (2015.01) |
| ***F21V 31/00*** | (2006.01) |
| *H01R 13/58* | (2006.01) |
| *H01R 33/97* | (2006.01) |
| *F21S 4/10* | (2016.01) |

(52) U.S. Cl.

CPC ..... *F21V 23/06* (2013.01); *F21V 15/01* (2013.01); *F21V 21/002* (2013.01); *F21V 23/001* (2013.01); *F21V 23/003* (2013.01); *F21V 31/005* (2013.01); *F21S 4/10* (2016.01); *H01R 13/5845* (2013.01); *H01R 33/06* (2013.01); *H01R 33/97* (2013.01)

(58) Field of Classification Search

CPC ..... H01R 33/09; H01R 33/06; H01R 33/97; H01R 13/5845; H01R 4/60; F21V 15/01; F21V 21/001; F21V 21/002; F21V 23/001; F21V 23/003; F21V 31/005; F21S 4/10

USPC ..... 439/357, 232, 605, 606, 350, 282, 356

See application file for complete search history.

(56) References Cited

U.S. PATENT DOCUMENTS

| | | | | |
|---|---|---|---|---|
| 2,499,825 A * | 3/1950 | Havlicek | ..... | H01R 13/6271 439/282 |
| 5,000,702 A * | 3/1991 | Forish | ..... | H01R 33/06 439/699.2 |
| 6,113,416 A * | 9/2000 | Holzer | ..... | H01R 33/06 439/357 |

(Continued)

*Primary Examiner* — Renee Luebke
*Assistant Examiner* — Paul Baillargeon

(57) ABSTRACT

The present invention relates to a plug-in bulb coupling structure, comprising a lamp cap provided on a bulb and a plug-in lamp holder provided on a power line, wherein a plug-in end of the plug-in lamp holder is provided with plug-in holes and raised barbs, and conductive tubes connected to a lead are provided in the plug-in holes; the plug-in end of the plug-in lamp cap is provided with conductive bars and barb holes, and the conductive bars are connected to a drive circuit board in the plug-in lamp cap. With the coupling structure of the present invention, the drive circuit board and the SR of the power line can be assembled and connected to each other quickly. The operation is easy, convenient and quick and does not require any tools.

6 Claims, 2 Drawing Sheets

(56) References Cited

U.S. PATENT DOCUMENTS

| | | | | |
|---|---|---|---|---|
| 6,582,253 | B1 * | 6/2003 | Lau | H01R 31/065<br>439/232 |
| 7,284,859 | B2 * | 10/2007 | Ferguson | A61B 3/1025<br>351/205 |
| 7,661,977 | B2 * | 2/2010 | Zayas | H01R 13/6275<br>439/357 |
| 8,222,801 | B2 * | 7/2012 | Wang | F21K 9/233<br>313/318.01 |
| 9,444,206 | B2 * | 9/2016 | Kitanishi | H01R 13/627 |
| 2007/0175516 | A1 * | 8/2007 | Tseng | F21V 21/002<br>137/231 |

* cited by examiner

PLUG-IN BULB COUPLING STRUCTURE

CROSS-REFERENCE TO RELATED APPLICATIONS

The present application claims the benefit of Chinese Patent Application No. 201510890833.4 filed on Dec. 4, 2015, the contents of which are hereby incorporated by reference.

TECHNICAL FIELD

The present invention relates to the technical field of lighting lamps, and in particular to a plug-in bulb coupling structure.

BACKGROUND OF THE PRESENT INVENTION

At present, a drive circuit inside a lamp cap of an existing commercially available LED string lamp product is generally directly connected to a power line by welding, resulting in complex assembly and production, low reliability and low production efficiency. Furthermore, the waterproof performance may be realized by additionally providing components such as a waterproof ring; and the reliability of products is not high due to a large number of parts.

SUMMARY OF THE PRESENT INVENTION

In order to solve the aforementioned problems in the prior art, the present invention provides a plug-in bulb coupling structure, by which, the drive circuit board and the SR of the power line can be assembled and connected to each other quickly; the operation is easy, convenient and quick and does not require any tools; the assembly process is significantly simplified and the assembly strength is enhanced, and the assembly efficiency is very high; furthermore, automated production can be realized.

The present invention employs the following technical solution to solve the aforementioned technical problem.

A plug-in bulb coupling structure is provided, including a lamp cap provided on a bulb and a plug-in lamp holder provided on a power line, wherein a plug-in end of the plug-in lamp holder is provided with plug-in holes and raised barbs, and conductive tubes connected to a lead are provided in the plug-in holes; the plug-in end of the plug-in lamp cap is provided with conductive bars and barb holes, and the conductive bars are connected to a drive circuit board in the plug-in lamp cap; and during assembly, the conductive bars are inserted into the barb holes one-to-one and connected to the conductive tubes, and meanwhile, the raised barbs are inserted into the barb slots and fasten an inner wall of the barb slots.

Further, the plug-in lamp holder includes an elastic soft holder body and an inner rigid frame, the inner rigid frame being mounted in a plug-in end of the soft holder body and having the plug-in holes and the raised barbs provided thereon; and both ends of the conductive tubes are arranged into the soft holder body and into the plug-in holes of the inner rigid frame, respectively.

Further, the plug-in holes and the raised barbs are one-stage injection molded with the inner rigid frame, and the inner rigid frame and the conductive tubes are two-stage injection molded with the soft holder body.

Further, a raised annular sealing skirt is provided in the periphery of the plug-in end of the soft holder body, and during assembly, the annular sealing skirt is connected to a shell of the plug-in lamp cap in a clingy manner.

Further, the annular sealing skirt is one-stage injection molded with the soft holder body.

Further, the soft holder body and the annular sealing skirt are injection molded from PVC soft plastic, and the inner rigid frame and the raised barbs are injection molded from PVC rigid plastic.

Further, the conductive tubes are conductive copper tubes.

The present invention has the following beneficial effects.

With the technical solution of the present invention, the drive circuit board of the bulb and the SR of the power line may be assembled and connected to each other quickly, and functions of permanent connection, electricity conduction, tensile resistance and waterproof performance may be realized at the same time; furthermore, the operation is easy, convenient and quick, the assembly process is significantly simplified and the assembly strength is enhanced, and the assembly efficiency is very high; furthermore, automated mass production may be realized due to the simple structure and low difficulty in production and machining.

Additionally, the annular sealing skirt seals a plug-in joint between the plug-in lamp cap and the plug-in lamp holder effectively, thus to achieve the waterproof and dustproof purposes. Since it is not required to additionally provide other parts such as a waterproof ring, the assembly is easier and the assembly efficiency is higher; and it is safer to use, and the performance is stable and reliable.

BRIEF DESCRIPTION OF THE DRAWINGS

The present invention will be further described below with reference to the accompanying drawings by specific embodiments.

DETAILED DESCRIPTION OF THE PRESENT INVENTION

In order to make the objective, technical solution and advantages of the present invention clearer, the present invention will be further described below in detail with reference to the accompanying drawings by an embodiment. It should be understood that the specific embodiment to be described herein is merely used to explain the present invention, and the present invention is not limited thereto.

Figure 1:
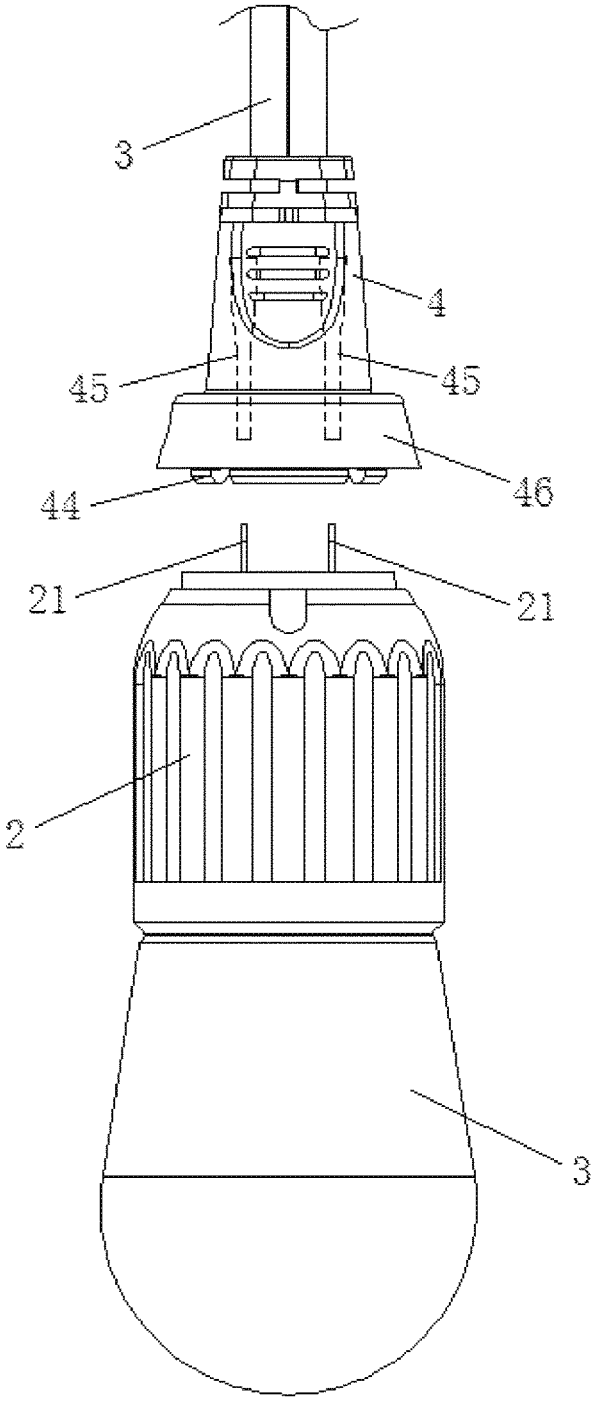
FIG. 1 is a schematic structure diagram of an embodiment of a plug-in bulb coupling structure according to the present invention.
Figure 2:
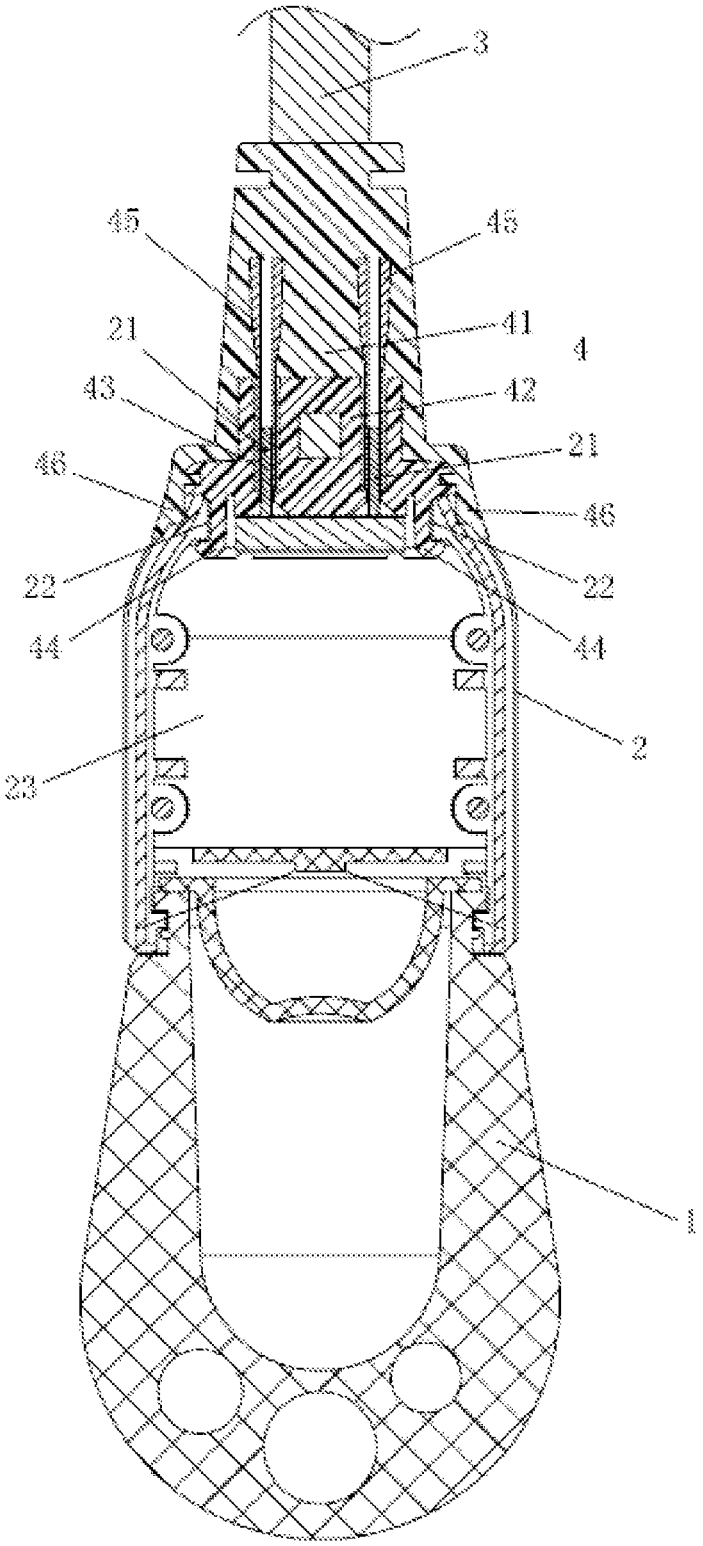
FIG. 2 is a sectional structure view of the embodiment of the plug-in bulb coupling structure according to the present invention.

As shown in FIG. 1 to FIG. 2:

a plug-in bulb coupling structure to be described in the embodiment of the present invention includes a lamp cap 2 provided on a bulb 1 and a plug-in lamp holder 4 provided on a power line 3. A plug-in end of the plug-in lamp holder 4 is provided with plug-in holes 43 and raised barbs 44, conductive tubes 45 connected to a lead are provided in the plug-in holes 43, and the conductive tubes 45 may be a conductive copper tube; and correspondingly, the plug-in end of the plug-in lamp cap 2 is provided with conductive bars 21 and barb slots 22, and the conductive bars 21 are connected to a drive circuit board 23 in the plug-in lamp cap 2.

During assembly, the conductive bars 21 are inserted into the plug-in holes 43 one-to-one and connected to the conductive tubes 45, and meanwhile, the raised barbs 44 are inserted into the barb slots 22 and fasten an inner wall of the barb slots 22.

In this way, with the plug-in bulb coupling structure of the present invention, the drive circuit of the bulb and the SR of the power line may be assembled and connected to each other quickly; the operation is easy, convenient and quick and does not require any tools; the assembly process is significantly simplified and the assembly strength is enhanced, and the assembly efficiency is very high; meanwhile, it facilitates the maintenance and replacement in the future; and it is easy to implement the plug-in bulb coupling structure of the present invention due to the simple structure and low difficulty in production and machining.

As a preferred solution of the present invention, the plug-in lamp holder 4 includes an elastic soft holder body 41 and an inner rigid frame 42, the inner rigid frame 42 being mounted in a plug-in end of the soft holder body 41 and having the plug-in holes 43 and the raised barbs 44 provided thereon; and both ends of the conductive tubes 45 are arranged into the soft holder body 41 and into the plug-in holes 43 of the inner rigid frame 42, respectively. The plug-in holes 43 and the raised barbs 44 are one-stage injection molded with the inner rigid frame 42 (for example, injection molded from PVC rigid plastic), and the inner rigid frame 42 and the conductive tubes 45 are two-stage injection molded with the soft holder body 411; a raised annular sealing skirt 46 is provided in the periphery of the plug-in end of the soft holder body 41, the annular sealing skirt 46 is one-stage injection molded with the soft holder body 41 (for example, injection molded from PVC soft plastic); and during assembly, the annular sealing skirt 46 is connected to a shell of the plug-in lamp cap 2 in a clingy manner.

In this way, the annular sealing skirt 46 may seal a plug-in joint between the plug-in lamp cap 2 and the plug-in lamp holder 4 effectively, thus to achieve the waterproof and dustproof purposes. Since it is not required to additionally provide other parts such as a waterproof ring, the assembly is easier and the assembly efficiency is higher; and it is safer to use, and the performance is stable and reliable.

What described above is a preferred implementation of the present invention, it should be noted that, for a person of ordinary skill in the art, various improvements and modifications may be made without departing from the principle of the present invention, and those improvements and modifications should be regarded as falling into the protection scope of the present invention.

What is claimed is:

1. A plug-in bulb coupling structure, comprising a plug-in lamp cap (2) provided on a bulb (1) and a plug-in lamp holder (4) provided on a power line (3); wherein a plug-in end of the plug-in lamp holder (4) is provided with plug-in holes (43) and raised barbs (44), and conductive tubes (45) connected to a lead are provided in the plug-in holes (43); a plug-in end of the plug-in lamp cap (2) is provided with conductive bars (21) and barb slots (22), and the conductive bars (21) are connected to a drive circuit board (23) in the plug-in lamp cap (2); and during assembly, the conductive bars (21) are inserted into the plug-in holes (43) one-to-one and connected to the conductive tubes (45), and meanwhile, the raised barbs (44) are inserted into the barb slots (22) and fasten an inner wall of the barb slots (22);

wherein the plug-in lamp holder (4) comprises an elastic soft holder body (41) and an inner rigid frame (42), the inner rigid frame (42) being mounted in a plug-in end of the soft holder body (41) and having the plug-in holes (43) and the raised barbs (44) provided thereon; and both ends of the conductive tubes (45) are arranged into the soft holder body (41) and into the plug-in holes (43) of the inner rigid frame (42), respectively.

2. The plug-in bulb coupling structure according to claim 1, wherein the plug-in holes (43) and the raised barbs (44) are one-stage injection molded with the inner rigid frame (42), and the inner rigid frame (42) and the conductive tubes (45) are two-stage injection molded with the soft holder body (41).

3. The plug-in bulb coupling structure according to claim 1, wherein a raised annular sealing skirt (46) is provided in the periphery of the plug-in end of the soft holder body (41), and during assembly, the annular sealing skirt (46) is connected to the plug-in lamp cap (2) in a clingy manner.

4. The plug-in bulb coupling structure according to claim 3, wherein the annular sealing skirt (46) is one-stage injection molded with the soft holder body (41).

5. The plug-in bulb coupling structure according to claim 1, wherein the soft holder body (41) and the annular sealing skirt (46) are injection molded from PVC soft plastic, and the inner rigid frame (42) and the raised barbs (44) are injection molded from PVC rigid plastic.

6. The plug-in bulb coupling structure according to claim 1, wherein the conductive tubes (45) are conductive copper tubes.

* * * * *